US006827780B2

(12) United States Patent
Bertellotti

(10) Patent No.: US 6,827,780 B2
(45) Date of Patent: Dec. 7, 2004

(54) METHOD AND APPARATUS FOR POWDER COATING HOLLOW OBJECTS

(75) Inventor: Christopher P. Bertellotti, New Britain, CT (US)

(73) Assignee: Nordson Corporation, Westlake, OH (US)

( * ) Notice: Subject to any disclaimer, the term of this patent is extended or adjusted under 35 U.S.C. 154(b) by 75 days.

(21) Appl. No.: 10/090,344

(22) Filed: Mar. 4, 2002

(65) Prior Publication Data

US 2002/0127332 A1 Sep. 12, 2002

Related U.S. Application Data

(60) Provisional application No. 60/273,672, filed on Mar. 6, 2001.

(51) Int. Cl.[7] ..... B05B 5/12

(52) U.S. Cl. ..... 118/622; 118/630; 118/629; 118/639; 118/318; 118/317

(58) Field of Search ..... 118/662, 9, 317, 118/318, 214, 215, 629, 630, 639, 306; 427/476, 105, 106, 107, 181, 182, 183, 230, 231, 232, 233, 234, 235, 236, 237, 238

(56) References Cited

U.S. PATENT DOCUMENTS 3,496,413 A 2/1970 Goodridge et al. ..... 317/3
3,850,660 A * 11/1974 Inamura et al. ..... 427/476
3,871,326 A * 3/1975 Kanda et al. ..... 118/63
3,901,185 A 8/1975 Goodridge et al. ..... 118/630
4,053,661 A 10/1977 Goodridge ..... 118/DIG. 5
4,098,226 A * 7/1978 Furter ..... 118/622
4,101,687 A 7/1978 Knudsen ..... 118/629
4,538,897 A * 9/1985 Osaka et al. ..... 399/29
4,729,513 A 3/1988 Fetcenko et al. ..... 239/707
4,958,587 A * 9/1990 Fogal et al. ..... 118/206
5,176,869 A * 1/1993 Okamoto et al. ..... 264/270
5,212,847 A 5/1993 Melcher et al. ..... 15/244.1
5,242,718 A 9/1993 Gillette et al. ..... 427/459
6,068,702 A * 5/2000 Bertellotti et al. ..... 118/621

* cited by examiner

*Primary Examiner*—Chris Fiorilla
*Assistant Examiner*—George Koch
(74) *Attorney, Agent, or Firm*—Wood, Herron & Evans, L.L.P.

(57) ABSTRACT

An apparatus for applying powder to at least an interior surface of a hollow object includes a powder discharge device adapted to receive powder and discharge the powder through an outlet. An object holder is configured to hold the object such that the outlet is positioned within the hollow object adjacent the interior surface. A rotating mechanism is configured to engage and rotate the hollow object such that the powder discharged from the outlet coats the interior surface as the interior surface rotates past the outlet. The powder discharge device may be a powder fluidizing bed unit including a chamber with a powder discharge opening in the form of an elongate slot.

16 Claims, 2 Drawing Sheets

METHOD AND APPARATUS FOR POWDER COATING HOLLOW OBJECTS

This application claims the benefit under 35 U.S.C. § 120 of Provisional Application Ser. No. 60/273,672 filed Mar. 6, 2001 and currently pending. The disclosure of that provisional application is hereby fully incorporated by reference herein.

FIELD OF THE INVENTION

The present invention generally relates to apparatus and methods for applying powder coatings to interior surfaces of hollow objects, such as cylindrical motor stators.

BACKGROUND OF THE INVENTION

Powder coating technology has generally evolved over several years into several different coating techniques performed with various types of coating systems. Generally, a powder, such as a resinous polymer or paint, is initially adhered to an electrically conductive object. This initial coating process typically involves electrically grounding the object and electrostatically charging the powder particles such that the electrostatic attraction causes the powder to adhere to the object. In most applications, it is desirable to coat the object with a uniform coating thickness. This initial powder coating is then cured using heat or other techniques, such as infrared or ultraviolet light. This fully adheres the coating to the object.

Applying powder to internal portions of certain objects presents unique problems. For example, electric motor stators are often shaped cylindrically with inwardly facing slots configured to receive copper windings. There must be an electrically insulating layer between the copper windings and the metal defining the slots of the stator. Therefore, when conventional electrostatic powder coating techniques are used to provide a layer of insulation on these metal surfaces, the powder must penetrate evenly into the slots of the stator. In this regard, the propensity is for the powder to more heavily coat the nearest surfaces. In addition, the strength of the electrostatic field diminishes as the distance from the charging medium increases. Thus, for example, the surface of a large stator that is relatively close to an electrostatic powder coating bed will receive a thicker coating than a surface that is relatively far from the bed.

Motor stators of different sizes present different types of powder coating problems and challenges. Generally, it is more difficult to fully penetrate deep slots with a uniform coating than it is to penetrate shallow slots. Powder spray guns have been attempted in such situations, but spray guns tend to impart too much powder velocity and therefore blow too much powder out of the slots and off the edges of the slots. On the other hand, parts have been placed in a powder cloud formed by electrostatic fluidized beds with the cylindrical object, such as the stator, held and tumbled or rotated directly within the powder cloud. This is suitable for smaller stators but, as mentioned above, larger stators will present problems with coating uniformity. Large cylindrical objects, such as motor stators, can also present handling difficulties.

Other types of powder coating devices have been used to coat hollow objects, such as fluidized beds into which a preheated hollow object is dipped, and powder spraying devices which include diffusers inserted into the hollow interior of the object for radially discharging powder with a 360° distribution pattern. Unfortunately, heating an object such as a motor stator with slots tends to cause the slots to heat up more than outer areas of the stator and this results in too much powder coating build up within the slots. Powder sprayers with 360° diffusers are used for internal pipe coating applications in which a large, relatively imprecise build up of powder is required and these devices are therefore not suitable for precision coating applications, such as stator coating.

For the reasons stated above, as well as other reasons, it would be desirable to provide powder application techniques and apparatus which can more uniformly and precisely coat internal portions of a hollow object, such as a large cylindrical motor stator or other object, while preferably reducing the handling problems associated with such large, hollow objects.

SUMMARY OF INVENTION

The present invention generally provides apparatus for applying powder to at least an interior surface of a hollow object. The apparatus includes a powder discharge device adapted to receive powder and discharge the powder through an outlet. An object holder is configured to hold the object such that the outlet is positioned within the hollow object adjacent to its interior surface. A rotating mechanism is configured to engage and rotate the hollow object such that powder discharging from the outlet coats the interior surface as the interior surface rotates past the outlet. In the preferred embodiment, the hollow object may be a large electric motor stator and the interior surface thereof may include slots which are adapted to receive copper windings after the coating operation is complete.

Although other types of powder discharge devices may be used in accordance with the invention, the preferred embodiment includes a chamber with the outlet positioned in an upper portion of the chamber. The chamber is adapted to receive and fluidize a bed of powder to form a powder cloud emanating upwardly through the outlet. More specifically, the chamber includes a porous member positioned in its lower portion below the bed of powder and an electrostatic charging device positioned in an air flow path leading through the porous member. A pressurized air inlet is provided for directing pressurized air into the air flow path such that the air is charged by the electrostatic charging device and then passes through the porous member and into the bed of powder.

The object holder more specifically comprises a pair of rollers configured to engage generally opposite sides of the exterior surface of the hollow object. A motor is coupled to at least one of the rollers to facilitate rotating the hollow object via, for example, frictional engagement with the motorized roller. The outlet of the powder discharge device preferably comprises an elongate slot configured to extend parallel to the axis of rotation of the hollow object. In the preferred embodiment, when coating an electric motor stator, the length of the slot is longer than the dimension between the end faces of the stator. This allows powder emanating from the slot to coat the end faces as well. The elongate slot may be formed between converging walls of the chamber. A transfer mechanism is preferably coupled to the powder discharge device and transfers the powder discharge device from a position outside the hollow object to a position within the hollow object. To further reduce handling of the large hollow object, the object is preferably held only by the rollers during the entire coating operation and, therefore, need not be manually positioned by an operator.

In the preferred embodiment, a powder collection unit is configured to collect excess powder which has not been applied to the object. For example, the rollers may be mounted within a lower chamber or second chamber having an interior coupled to a powder collection unit supplied with vacuum. Thus, as the rollers rotate against the outside surface of the hollow object, such as the electric stator, excess powder on the outside surface of the object electrostatically adheres to the outside surfaces of the rollers. Powder removing devices may be positioned within the second chamber to remove the powder from the rollers for subsequent collection by the powder collection unit. For example, positive pressurized air may be directed at the outside surfaces of the rollers and/or brushes or scrapers may be engaged with the outside surfaces of the rollers to facilitate this powder removal function.

A method performed in accordance with the inventive principles generally includes positioning a powder discharge device having a powder discharge outlet within a hollow object, such as an electric motor stator; directing a stream of the powder through the powder discharge outlet; and rotating the object with the interior surface positioned adjacent the opening and in contact with the stream of powder. The method preferably comprises forming a powder cloud within the chamber and moving the powder cloud within the chamber generally toward the powder discharge outlet. The powder cloud may be moved toward and through the outlet by introducing electrostatically charged, pressurized air through the bed of powder. The object is preferably at ground potential. In the preferred embodiment, as mentioned above, the object is a motor stator having internal slots and the method further comprises directing the powder stream within the internal slots and, more preferably, also onto the opposite end faces of the stator.

These and other features, objects and advantages of the invention will be more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 1:
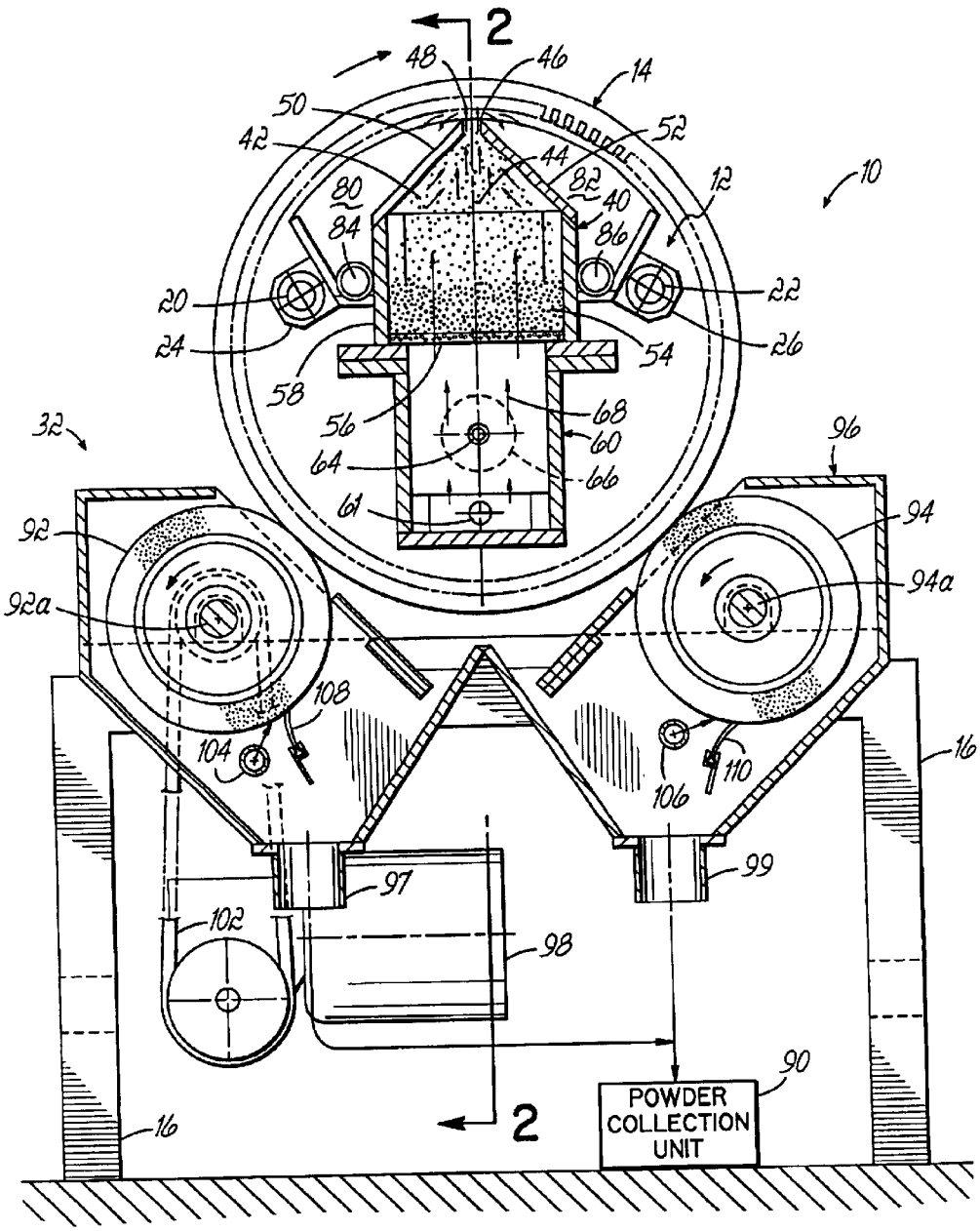
FIG. 1 is a side elevational view of a preferred coating apparatus constructed in accordance with the invention, sectioned generally along line 1—1 of FIG. 2 to show inner details of the upper and lower chambers.
Figure 2:
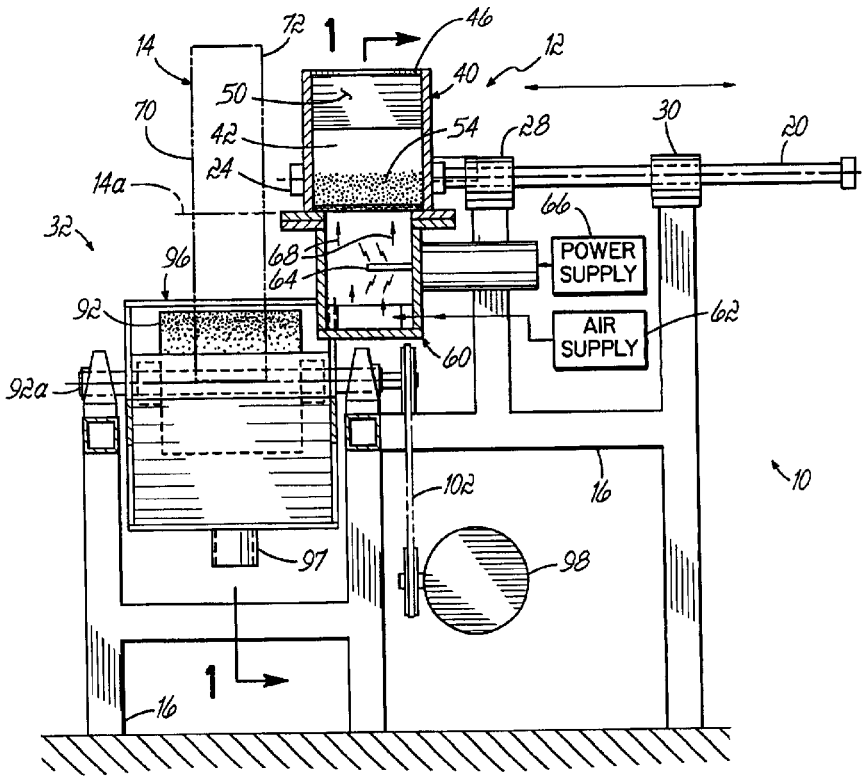
FIG. 2 is a cross sectional view taken generally along line 2—2 of FIG. 1.

FIGS. 1 and 2 illustrate one preferred form of a powder coating apparatus 10 constructed in accordance with the principles of the invention. Generally, powder coating apparatus 10 includes a fluidized bed powder coating unit 12 which is insertable into a hollow object, such as a large electric motor stator 14. Powder coating unit 12 is supported by a suitable support structure or frame 16 and, as viewed in FIG. 2, powder coating unit 12 may be reciprocated or otherwise moved into and out of stator 14 using, for example, a pair of rods 20, 22 fixed to powder coating unit 12 by suitable connectors 24, 26 and received for sliding movement within bushings 28, 30. This reciprocating movement may be manual or may be powered using a suitable motorized device (not shown). The same frame 16 may support a lower object holding and powder collection structure 32 as will be described further below.

Powder coating unit 12 generally comprises a chamber 40 having an interior 42 in which a powder cloud 44 is formed and an upper opening 46 through which a powder stream 48 is emitted at a relatively higher velocity than the velocity of the cloud 44 within the interior 42 of the chamber 40. Preferably, as one manner of imparting the required velocity, converging walls 50, 52 form the top of the chamber 40 leading toward the opening 46. The powder cloud 44 is formed in a generally conventional manner using a bed 54 of powder disposed on a porous plate 56 located at a lower portion 58 of the chamber 40. A subchamber 60 receives pressurized air through an inlet 61 from a suitable air supply 62. This air is electrostatically charged by an electrode 64 within the subchamber 60, or by any other suitable charging device, receiving high voltage from a power supply 66. The electrostatically charged air represented by arrows 68 then proceeds through porous plate 56 and into the powder bed 54 whereupon it electrostatically charges the powder. The powder stream 48 adheres to the stator 14 upon discharge from the opening 46 as the stator 14 is maintained at ground potential.

Figure 3:
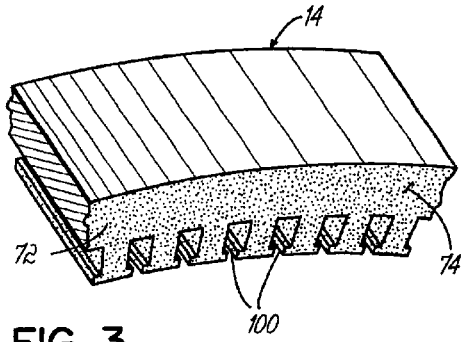
FIG. 3 is a perspective view of a stator fragment illustrating a powder coated end face and slots.
Figure 4:
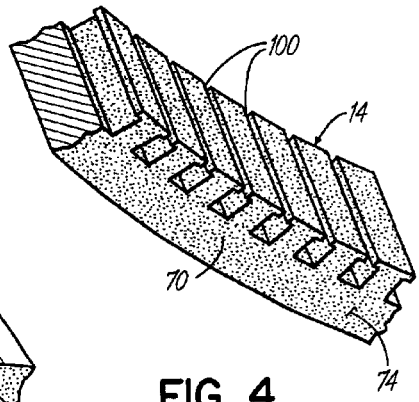
FIG. 4 is a perspective view of the stator fragment showing powder coated internal portions and the opposite end face.

As shown in FIG. 2, opening 46 is preferably an elongate slot having a length dimension greater than the length dimension of the stator 14 between opposite end faces 70, 72 thereof. Therefore, portions of powder stream 48 discharged from opposite ends of the opening or slot 46 will coat the opposite end faces 70, 72 of the stator 14. Thus, all of the surfaces shown in FIGS. 3 and 4 will preferably receive a uniform powder coating 74.

Referring more specifically to FIG. 1, powder which does not adhere to stator 14 is drawn into collection areas 80, 82 on opposite sides of opening 46. Specifically, the powder is drawn into respective ports 84, 86 which are connected to conduits (not shown) and ultimately to a suitable powder collection unit 90 including a source of vacuum. During the coating process, stator 14 is supported on a pair of rollers 92, 94 located on generally opposite sides of stator 14. These rollers 92, 94 are mounted in a second, lower chamber 96 also coupled for fluid communication with powder collection unit 90 through ports 97, 99 connected to conduits (not shown). Specifically rollers 92, 94 may be mounted on rotatable shafts 92*a*, 94*a* coupled to frame 16. One of the rollers 92 is coupled to an electric motor 98 which rotates the roller 92 during a powder coating operation to thereby rotate stator 14 about its axis 14*a*. Stator 14 is rotated at a speed ensuring uniform coating of the interior surfaces thereof, including the slots 100 (FIGS. 3 and 4) and, preferably, the exterior end faces 70, 72 as well. During the coating process, coating unit 12 is held stationary. As shown, a belt 102 may be coupled between roller 92 and motor 98, or any other rotating drive mechanism may be used as appropriate or desired. Rollers 92, 94 are also at ground potential and, therefore, any excess powder on the outside surface of stator 14 will adhere to the outside contact surfaces of the rollers 92, 94. This excess powder is removed from the rollers 92, 94 by, for example, directing positive pressurized air from respective supply pipes or nozzles 104, 106 and/or using suitable scrapers or brushes 108, 110. In this manner, the powder is removed from the rollers 92, 94 and suctioned into powder collection unit 90.

While the present invention has been illustrated by a description of a preferred embodiments and while these embodiments have been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

However, the invention itself should only be defined by the appended claims, wherein I claim:

1. Apparatus for applying powder to at least an interior surface of a hollow object, the apparatus comprising:

a powder discharge device adapted to receive powder and discharge the powder through an outlet;

an object holder configured to hold said object such that said outlet is positioned within the hollow object adjacent the interior surface; and a rotating mechanism configured to engage and rotate the hollow object about an axis of rotation such that powder discharging from the outlet coats the interior surface as the interior surface rotates past the outlet, wherein the outlet is oriented to discharge the powder In a direction transverse to the axis of rotation and normal to the outlet;

wherein said powder discharge device further comprises a chamber, and said outlet is positioned in an upper portion of said chamber, said chamber adapted to receive and fluidize a bed of the powder to form a powder cloud discharging through said outlet.

2. The apparatus of claim 1, further comprising:

a porous member positioned at a lower portion of said chamber below the bed of powder and having an upper side facing the bed of powder and an opposite lower side;

an electrostatic charging device positioned in an air flow path leading to said lower side of said porous member; and a pressurized air inlet for directing pressurized air into said air flow path such that the air is charged by said electrostatic charging device and then passes respectively through the lower and upper sides of said porous member and into the bed of powder.

3. The apparatus of claim 1, wherein the hollow object includes an exterior surface and said object holder further comprises a pair of rollers configured to engage generally opposite sides of the exterior surface, and said rotating mechanism further comprises a motor coupled to at least one of said rollers.

4. The apparatus of claim 1, wherein said outlet further comprises an elongate slot configured to extend parallel to the axis of rotation.

5. The apparatus of claim 4, wherein said powder discharge device includes a chamber and said elongate slot is formed between converging walls of said chamber.

6. The apparatus of claim 1, further comprising:

a transfer mechanism coupled to said powder discharge device and operative to transfer said powder discharge device from a position outside the hollow object to a position within the hollow object.

7. Apparatus for applying powder to at least an interior surface of a hollow object, the apparatus comprising:

a chamber having an upper portion, a lower portion, and a inclined walls converging in a direction from said lower portion toward said upper portion;

a powder fluidizing bed disposed at said lower portion of said chamber and adapted to receive and fluldize a bed of the powder to form a powder cloud emanating upwardly from said lower portion, through said converging area to said upper portion of said chamber;

an outlet positioned at said upper portion of said chamber and configured to direct at least one stream of said powder from said powder cloud out of said chamber, said outlet positioned at a location between said inclined walls;

a powder collection unit positioned to collect excess powder which has not been applied to the object;

an object holder configured to hold the object such that said outlet is positioned within the hollow object adjacent the interior surface; and a rotating mechanism configured to engage and rotate the hollow object such that powder discharging from the outlet coats the interior surface as the interior surface rotates past the outlet.

8. The apparatus of claim 7, further comprising:

a porous member disposed at said lower portion of said chamber below the bed of powder and having an upper side facing the bed of powder and an opposite lower side;

an electrostatic charging device positioned in an air flow path leading to said lower side of said porous member; and a pressurized air inlet for directing pressurized air into said air flow path such that the air is charged by said electrostatic charging device and then passes respectively through the lower and upper sides of said porous member and into the bed of powder.

9. The apparatus of claim 7, wherein the hollow object includes an exterior surface and said object holder further comprises a pair of rollers configured to engage generally opposite sides of the exterior surface, and said rotating mechanism further comprises a motor coupled to at least one of said rollers.

10. The apparatus of claim 7, wherein the rotation mechanism rotates the hollow object about an axis of rotation and said outlet further comprises an elongate slot configured to extend parallel to the axis of rotation.

11. The apparatus of claim 7, further comprising:

a transfer mechanism coupled to said chamber and operative to transfer said chamber from a position outside the hollow object to a position within the hollow object.

12. Apparatus for applying powder to at least an interior surface of a hollow object, the apparatus comprising:

a first chamber having an upper portion, a lower portion and an outlet in said upper portion;

a powder fluidizing bed disposed at said lower portion of said first chamber and adapted to receive and fluidize a bed of the powder to form a powder cloud emanating upwardly from said lower portion to said upper portion and through said outlet;

an object holder configured to hold the object such that said outlet is positioned within the hollow object adjacent the interior surface;

a powder collection area positioned outside said first chamber;

a rotating mechanism configured to engage and rotate the hollow object about an axis of rotation such that powder discharging from the outlet coats the interior surface as the interior surface rotates past the outlet, wherein the outlet is oriented to discharge the powder in a direction transverse to the axis of rotation and normal to the outlet; and a powder collection unit connected in fluid communication with said powder collection area for collecting excess powder which has not been applied to the object.

13. The apparatus of claim 12, further comprising a second chamber positioned below said first chamber, wherein the hollow object includes an exterior surface and said object holder further comprises a pair of rollers mounted within said second chamber and configured to engage generally opposite sides of the exterior surface, and said rotating mechanism further comprises a motor coupled to at least one of said rollers.

14. The apparatus of claim 13, further comprising:

respective powder removing devices within said second chamber and operating to remove powder from said rollers for subsequent collection by said powder collection unit.

15. The apparatus of claim 14, wherein said respective powder removing devices further comprise a nozzle oriented to direct positive pressurized air toward the corresponding one of said pair of rollers.

16. The apparatus of claim 12, further comprising:

a transfer mechanism coupled to said first chamber and operative to transfer said first chamber from a position outside the hollow object to a position within the hollow object.

* * * * *

UNITED STATES PATENT AND TRADEMARK OFFICE

CERTIFICATE OF CORRECTION

PATENT NO. : 6,827,780 B2
DATED : December 7, 2004
INVENTOR(S) : Christopher P. Berellotti It is certified that error appears in the above-identified patent and that said Letters Patent is hereby corrected as shown below:

Column 5,
Line 23, change “In” to -- in --.
Line 63, delete “a”.

Column 6,
Line 34, change “rotation” to -- rotating --.

Signed and Sealed this

Twenty-fourth Day of May, 2005

JON W. DUDAS
*Director of the United States Patent and Trademark Office*